US010538981B2

(12) United States Patent
Covalt et al.

(10) Patent No.: US 10,538,981 B2
(45) Date of Patent: Jan. 21, 2020

(54) OPPOSING PISTON SETTING TOOL

(71) Applicant: Hunting Titan, Inc., Pampa, TX (US)

(72) Inventors: Johnny Covalt, Cleburne, TX (US); Rick Smith, Whitney, TX (US)

( * ) Notice: Subject to any disclaimer, the term of this patent is extended or adjusted under 35 U.S.C. 154(b) by 194 days.

(21) Appl. No.: 15/563,798

(22) PCT Filed: Apr. 1, 2016

(86) PCT No.: PCT/US2016/025732
§ 371 (c)(1),
(2) Date: Oct. 2, 2017

(87) PCT Pub. No.: WO2016/161379
PCT Pub. Date: Oct. 6, 2016

(65) Prior Publication Data

US 2018/0080298 A1 Mar. 22, 2018

Related U.S. Application Data

(60) Provisional application No. 62/142,083, filed on Apr. 2, 2015.

(51) Int. Cl.
*E21B 23/06* (2006.01)

(52) U.S. Cl.
CPC ..... *E21B 23/065* (2013.01)

(58) Field of Classification Search
CPC ..... E21B 23/065; E21B 23/00; E21B 23/06; E21B 23/08
See application file for complete search history.

(56) References Cited

U.S. PATENT DOCUMENTS 2,618,343 A * 11/1952 Conrad ..... E21B 23/065 166/120
2,640,546 A * 6/1953 Baker ..... E21B 23/065 166/125
2,695,065 A 11/1954 Baker et al.
2,799,343 A * 7/1957 Conrad ..... E21B 23/065 166/63
2,815,817 A * 12/1957 Conrad ..... E21B 33/1275 166/117
3,036,636 A * 5/1962 Clark, Jr. ..... E21B 23/06 166/123
3,138,207 A 6/1964 Peppers
3,186,485 A 6/1965 Owen
3,220,480 A 11/1965 Myers
3,298,437 A * 1/1967 Conrad ..... E21B 23/065 166/120
4,535,842 A 8/1985 Ross
5,240,077 A 8/1993 Whitsitt

OTHER PUBLICATIONS

Notification concerning transmittal of international preliminary report on patentability, PCT Application No. PCT/US2016/25732, dated Oct. 12, 2017, 7 pages.

(Continued)

*Primary Examiner* — Wei Wang
(74) *Attorney, Agent, or Firm* — Christopher McKeon; Jason Saunders; Arnold & Saunders, LLP

(57) ABSTRACT

A setting tool for use in setting plugs downhole using opposing pistons to axially compress a plug, thereby causing it to radially expand.

31 Claims, 1 Drawing Sheet

(56) References Cited

OTHER PUBLICATIONS

Notification of Transmittal of the International Search Report and the Written Opinion of the International Searching Authority, PCT Application No. PCT/US2016/25732, dated Aug. 22, 2016, 11 pages.
Supplemental European Search Report, EP16774377, dated Mar. 5, 2019, 5 pages.
Office action, Canadian application No. 2,980,935, dated Aug. 2, 2018, 4 pages.
Response to Office action, Canadian application No. 2,980,935, dated Feb. 1, 2019, 8 pages.

* cited by examiner

OPPOSING PISTON SETTING TOOL

RELATED APPLICATIONS

This application claims priority to U.S. Provisional Application No. 62/142,083, filed Apr. 2, 2015.

BACKGROUND OF THE INVENTION

Bridge plugs are often introduced or carried into a subterranean oil or gas well on a conduit, such as wireline, electric line, continuous coiled tubing, threaded work string, or the like, for engagement at a pre-selected position within the well along another conduit having an inner smooth inner wall, such as casing. The bridge plug is typically expanded and set into position within the casing. The bridge plug effectively seals off one section of casing from another. Several different completion operations may commence after the bridge plug is set, including perforating and fracturing. Sometimes a series of plugs are set in an operation called "plug and perf" where several sections of casing are perforated sequentially. When the bridge plug is no longer needed the bridge plug is reamed, often through drilling, reestablishing fluid communication with the previously sealed off portion of casing.

Setting a bridge plug typically requires setting a "slip" mechanism that engages and locks the bridge plug with the casing, and energizing the packing element in the case of a bridge plug. This requires large forces, often in excess of 20,000 lbs. The activation or manipulation of some setting tools involves the activation of an energetic material such as an explosive pyrotechnic or black powder charge, sometimes called a "power charge" to provide the energy needed to deform a bridge plug. The energetic material may use a relatively slow burning chemical reaction to generate high pressure gases. One such setting tool is the Model E-4 Wireline Pressure Setting Tool of Baker International Corporation, sometimes referred to as the Baker Setting Tool.

The pressure from the power charge igniting is contained with the power charge chamber by the sealed firing head. The pressure builds in the chamber and causes a floating first piston to move down through the tool, compressing the oil reservoir through a small hole in a connector sub.

The oil is pressed through the small hole in the connector sub and against a second piston. The hydraulic force applied against the second piston causes the piston to move. The second piston is coupled to a setting sleeve by way of a piston rod and sleeve crosslink. The setting sleeve moves away axially from the setting tool and compresses the outside of a bridge plug. A mandrel located down the center of the tool stays stationary. The mandrel is connected to the bridge plug via a shear stud. After the bridge plug is set, the setting tool is pulled upwards in the borehole until sufficient force is generated to shear the shear stud, thus separating the setting tool from the bridge plug.

After the bridge plug is set, the explosive setting tool may remain pressurized and must be raised to the surface and depressurized. This typically entails bleeding pressure off the setting tool by piercing a rupture disk or releasing a valve.

SUMMARY OF EXAMPLES OF THE INVENTION

An example embodiment may include a setting tool apparatus having a substantially cylindrical body with a center axis. It may also have a first chamber, a first piston slidably disposed within the first chamber and a first piston face. It may include a mandrel extending normal from the first piston face in a first direction, and a second piston slidably disposed in the first chamber. The embodiment may have a second piston face and an axial through bore. The mandrel of the first piston may slidably engage the axial through bore of the second piston. The first piston face, the second piston face, and the cylindrical body may form a pressure chamber.

A variation of the described embodiment may include the second piston moving along the axis in a first direction. The cylindrical body may move along the axis in the first direction. The embodiment may further have a shear stud coupled to the end of the mandrel. The second piston is located between the first piston and the shear stud along the mandrel. The embodiment may further have an expandable plug coupled to the shear stud. The expandable plug may be a bridge plug. The embodiment may further have a vent. A fluid can enter the pressure chamber. A first oil reservoir may be formed by the first piston and the cylindrical body. A second oil reservoir is formed by the second piston and the cylindrical body. The fluid may be a gas resulting from a chemical reaction. The fluid may be a hydraulic fluid.

Another example embodiment may include a setting tool apparatus having a cylindrical body with a center axis, a first end, a second end, an inner surface, and an outer surface. The setting tool has a first piston located within the cylindrical body and axially aligned with the cylindrical body. The first piston has a first end and a second end. It also has a fluid passage connecting the first end to the second end. A cylindrical mandrel extends from the second end of the first piston and is axially aligned with the cylindrical body. A second piston is located within the cylindrical body and is axially aligned with the cylindrical body. The second piston has an axial bore throughout its length. The second piston has a first end and a second end. The first end of the second piston, the second end of the first piston, and the cylindrical body form a variable volume pressure chamber.

A variation of the described embodiment may further include a sub connected to the first end of the cylindrical body having at least one orifice placing a first portion of the inside of the cylindrical body in fluid communication with the outside of the cylindrical body. The embodiment may have a sub connected to the second end of the cylindrical body. The sub may have at least one orifice placing a second portion of the inside of the cylindrical body in fluid communication with the outside of the cylindrical body. The embodiment may further have a power charge located proximate to the cylindrical body. The gases generated by the power charge can enter the fluid passage of the first piston at the first end and exit at the end of the fluid passage at the second end. The gases generated would then enter the variable volume pressure chamber. A firing head is coupled to the power charge. The mandrel may be disposed within the axial bore of the second piston. It may further have a cylindrical sub coupled to the second end of the cylindrical body. The cylindrical sub limits the stroke of the second piston with respect to the cylindrical body. It may further have a cylindrical sub coupled to the first end of the cylinder body. The cylindrical sub limits the stroke of the second piston with respect to the cylindrical body. It may further have a setting sleeve coupled to the second piston. It may further have a connector sub coupled to the mandrel. It may further have a shear stud coupled to the connector sub. It may further have an expandable plug coupled to the shear stud. The first piston may stay stationary while the second piston and cylindrical body each move axially away from the first piston. The fluid passage may provide fluid communication for a gas between the first end of the first piston and the variable volume pressure chamber.

Another example embodiment may include a method for setting a plug in a borehole. The method step may include activating a firing head, starting a gas pressure generating chemical reaction, pressurizing a chamber located with a cylinder with the generated gas pressure, moving a piston disposed within the cylinder in a first axial direction with the generated gas, and moving the cylinder in the first axial direction with the generated gas.

A variation of the example may further include placing a setting tool in a borehole at a predetermined location for installing a bridge plug. It may further include evacuating a first quantity of oil from the setting tool by moving the piston in the first axial direction. It may further include evacuating a second quantity of oil from the setting tool by moving the cylinder in the first axial direction. It may further include expanding a seal radially against an inner wall of a borehole casing. It may further include shearing a shear stud coupled between a setting tool and a setting plug. It may further include removing the setting tool from the borehole after setting a bridge plug. The radially expanded seal may be a bridge plug.

Another example embodiment may include a setting tool having a charge chamber and a cylindrical body having a top end and a bottom end. The setting tool may have a longitudinal axis extending through its center from the top end to the bottom end. It may have a top piston with a top end and a bottom end corresponding with the top end and bottom end of the pressure vessel. The top piston may provide a slidable seal within the pressure chamber cylinder. The setting tool may have a bottom piston with a top end and a bottom end corresponding with the top end and bottom end of the pressure vessel. The bottom piston may provide a slidable seal within the pressure chamber cylinder. A top piston mandrel connects the charge chamber to the top end of the top piston through the top end of the cylindrical body. A gas passage through the top piston mandrel provides fluid communication from the energetic material chamber to the pressure chamber cylinder between the top and bottom piston. A bottom piston mandrel connects the bottom piston to a setting sleeve. A setting mandrel extends from the bottom end of the top piston through the bottom piston and bottom piston mandrel. The top piston, bottom piston, and cylindrical body form a pressure chamber.

A variation of the example may further have a top fluid reservoir formed between the top end of the top piston and the top end of the cylindrical body. It may further have a bottom fluid reservoir formed between the bottom end of the bottom piston and the top end of the cylindrical body. It may further have a top orifice proximate to the top end of the cylindrical body. The top orifice is adapted to release fluid from the top fluid reservoir under pressure. It may further have a bottom orifice proximate the bottom end of the cylindrical body. The bottom orifice is adapted to release fluid from the bottom fluid reservoir under pressure. It may further have a bottom sub proximate the bottom end of the cylindrical body adapted to stop the bottom piston from exiting the bottom end of the cylindrical body. It also has a top sub proximate the top end of the cylindrical body adapted to stop the top piston from exiting the top of the cylindrical body. The charge chamber, pressure chamber cylinder, top piston, and bottom piston may all be coaxially aligned. The top piston mandrel, bottom piston mandrel, setting sleeve, and setting mandrel may all be coaxially aligned. It may further have an energetic charge disposed within the charge chamber. The combustion of the energetic charge creates gas that flows through the gas passage to the pressure chamber. The pressure created by the gas moves the bottom piston toward the bottom sub and further moves the top end of the cylindrical body down toward the top piston. The bottom piston may move toward the bottom sub to pressurize fluid in the bottom fluid reservoir and move it through the bottom orifice. The top end of the cylindrical body may move toward the top piston to pressurize fluid in the top fluid reservoir and move it through the top orifice.

BRIEF DESCRIPTION OF THE DRAWINGS

For a thorough understating of the present invention, reference is made to the following detailed description of the preferred embodiments, taken in conjunction with the accompanying drawings in which reference numbers designate like or similar elements throughout the several figures. Briefly.

DETAILED DESCRIPTION OF EXAMPLES OF THE INVENTION

In the following description, certain terms have been used for brevity, clarity, and examples. No unnecessary limitations are implied and such terms are used for descriptive purposes only and are intended to be broadly construed. The different apparatus and method steps described herein may be used alone or in combination with other systems and method steps. It is to be expected that various equivalents, alternatives, and modifications are possible within the scope of the presented claims.

Figure 1:
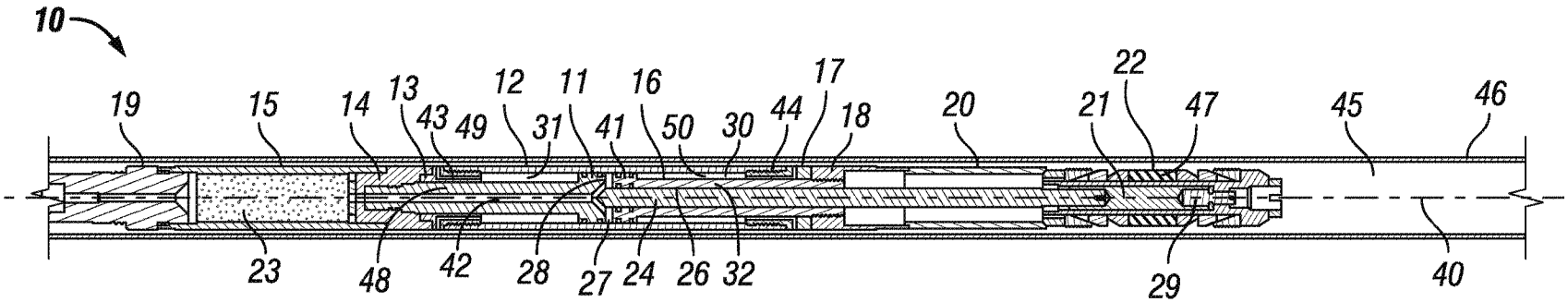
FIG. 1 is cross section of an example wireline setting tool as it is lowered into a wellbore.

An example embodiment is illustrated in the wireline setting tool 10 of FIG. 1. The setting tool 10 includes a top piston 11 located within the cylindrical body 12. An orifice sub connects the cylindrical body 12 with the shear sub 14. Power charge chamber 15 contains the gas generating energetic material 23. Bottom piston 16 is located in the cylindrical body 12 opposite of top piston 11. Top piston 11 has a mandrel 24 attached to the face 28 of the top piston 11. Bottom piston 16 has a through bore 26 that slidably receives the mandrel 24. Retainer sub 17 slidably engages the bottom piston 16 and limits the linear travel of bottom piston 16. Attachment sub 18 interfaces the bottom piston 16 with the setting sleeve 20. Top piston 11 and bottom piston 16, combined with cylindrical body 12, create a variable volume pressure chamber 27. In this configuration a plug 22 is attached to the setting tool using a shear stud 29. Shear stud 29 is connected to a connector sub 21, which is then connected to the mandrel 24. Pistons 11 and 16 can seal inside the body 12 using o-rings, piston rings, gaskets, or other well-known sealing methods.

Figure 2:
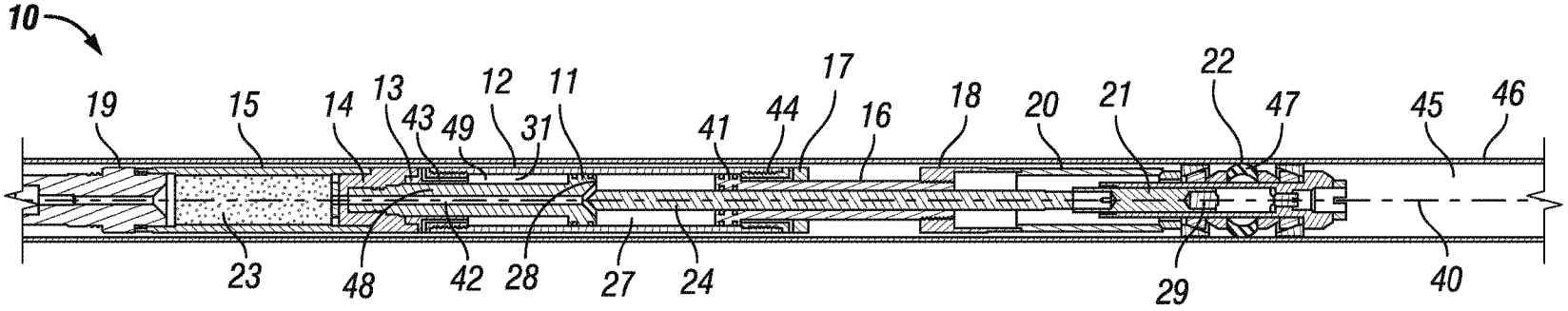
FIG. 2 is cross section of an example wireline setting tool partially stroked.

In typical operation a gas generating explosive material 23 is electrically ignited. The gases generated by the power charge 23 enters chamber 27 by way of the gas vent 28, exerting pressure on top piston 11 and lower piston 16. The pressure buildup in pressure chamber 27 causes lower piston 16 to move downward as shown in FIG. 2. Fluid 30 is held in a fluid reservoir 50 located between the piston body 32 and the cylindrical body 12. The movement of lower piston 16 downward causes the fluid 30 to vent out of the setting tool 10 via vents in the retainer sub 17. The fluid 30 could be any hydraulic fluid or other suitable fluid, such as oil, glycol, or water. Retainer sub 17 limits the downward travel of lower piston 16 with respect to the cylindrical body 12.

Referring to FIG. 2, as the lower piston 16 slides downward relative to the mandrel 24, it causes setting sleeve 20 to move downward as well, relative to the mandrel 24. As the setting sleeve 20 moves downward it begins to collapse the plug 22 linearly, thereby causing it to expand radially. The center of plug 22 is held in place by mandrel 24. The full stroke of lower piston 16 may be sufficient to set the plug 22.

As the lower piston 16 bottoms out, the forces due to the pressure in chamber 27 will start to act against the cylindrical body 12 as it is still slidably engaged to upper piston 11 and cause the cylindrical body 12 to move in relation to upper piston 11, further expanding chamber 27. As the cylindrical body 12 moves downward relative to a stationary piston 11, fluid 31 in fluid reservoir 49, formed by piston 11 and cylindrical body 12, is vented out of the setting tool 10 via an orifice or valve in orifice sub 13. The fluid 31 could be any hydraulic fluid or other suitable fluid, such as oil, glycol, or water.

When sufficient pressure is generated in pressure chamber 27, the bottom piston 16 will move downward as shown in FIG. 2. As bottom piston 16 moves downward, the mandrel 24 stays stationary, thus pulling the plug 22 through the setting sleeve 20. This action causes the bridge plug to collapse against itself axially and expand outwardly to seal a borehole. The fluid 30 and fluid 31 provides resistance to the movement of upper piston 11 and lower piston 16 relative to the cylindrical body 12, thus reducing dynamic loading effects of the rapid pressure buildup in chamber 27 and allowing the plug 22 to properly set with more controlled forces.

Figure 3:
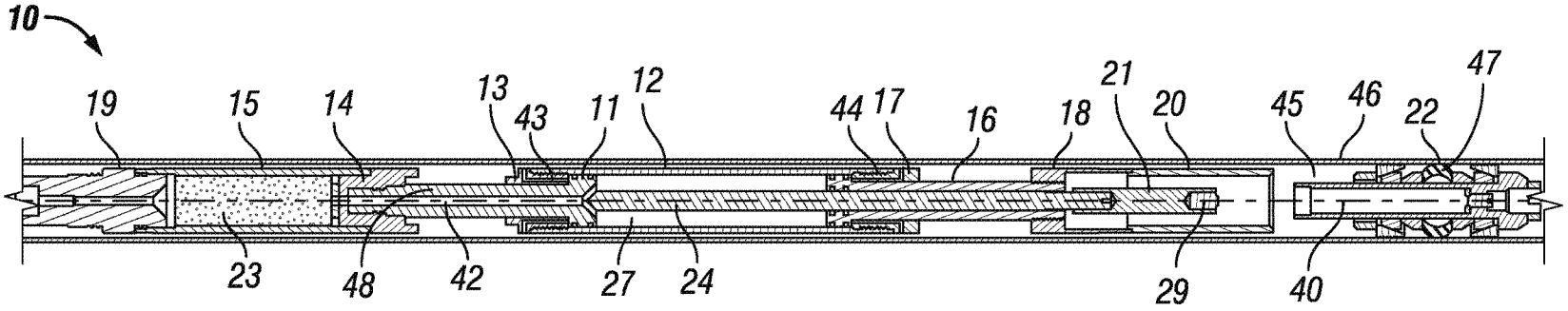
FIG. 3 is cross section of an example wireline setting tool after setting a plug.

Referring to FIG. 3, as the shear sub 14 bottoms out against upper piston 11, the setting tool 10 will be fully stroked. The full stroke of upper piston 11, in combination with the full stroke of lower piston 16, is sufficient to set the plug 22 and then separate the setting tool 10 from the plug 22 by shearing shear stud 29. After this, the setting tool 10 can be removed from the cased wellbore, leaving behind plug 22.

Another example embodiment may include a setting tool 10 with a substantially cylindrical body 12 with a center axis 40, a first piston 11 slidably disposed within the cylindrical body 12. The first piston 11 may have a first piston face 28 and a mandrel 24 extending normal from the first piston face 28 in a first direction downhole. The setting tool 10 may include a second piston 16 slidably disposed in the cylinder 12 and having a second piston face 41 and an axial through bore 26. The mandrel 24 of the first piston 11 slidably engages through the axial through bore 26 of the second piston 16. The first piston face 28, the second piston face 41, and the cylindrical body 12 in this example form a pressure chamber 27.

A variation of this described embodiment may include the second piston 16 moving along the axis 40 in a first direction. The cylindrical body 12 may move along the axis 40 in the first direction. The embodiment may further have a shear stud 29 coupled to the bottom end of the mandrel 24. The second piston 16 is located between the first piston 11 and the shear stud 29 along the mandrel 24. The embodiment may further have an expandable plug 22 coupled to the shear stud 29. The expandable plug 22 may be a bridge plug. The embodiment may further have a vent 42. A fluid can enter the pressure chamber 27 via vent 42. A first fluid reservoir 49 may be formed by the first piston 11 and the cylindrical body 12 and containing fluid 31. A second fluid reservoir 50 is formed by the second piston 16 and the cylindrical body 12 and containing fluid 30. Fluids 30 and 31 can be an oil, hydraulic fluid, glycerol, water, or other suitable fluids.

Another example embodiment may include a setting tool 10 having a cylindrical body 12 having a center axis 40, a first end, a second end, an inner surface, and an outer surface, and a first piston 11 located within the cylindrical body 12. The cylindrical body 12 and the first piston 11 may be axially aligned. The first piston 11 may have a first end and a second end, and a fluid passage 42 connecting the first end to the second end. A cylindrical mandrel 24 may extend from the second end of the first piston 11. The mandrel 24 may be axially aligned with the cylindrical body 12. The setting tool 10 may include a second piston 16 located within the cylindrical body 12 and axially aligned with the cylindrical body 12. The second piston 16 may have an axial bore 26 throughout the length of the second piston 16, with a first end and a second end. The first end of the second piston 16, the second end of the first piston 11, and the cylindrical body 12 may form a variable volume pressure chamber 27.

A variation of the described embodiment may further include a cylindrical sub 13 connected to the first end of the cylindrical body 12 having at least one orifice 43 placing a first portion of the inside of the cylindrical body 12 in fluid communication with the outside of the cylindrical body. The embodiment may further have a retainer sub 17 connected to the second end of the cylindrical body 12 having at least one orifice 44 placing a second portion of the inside of the cylindrical body 12 in fluid communication with the outside of the cylindrical body 12. The embodiment may further have a power charge chamber 15 located proximate to the cylindrical body 12. Gases generated by the power charge can enter the fluid passage 42 of the first piston 11 at the first end and exit at the end of the fluid passage 42 at the second end, thus entering the variable volume pressure chamber 27. It may further include a firing head 19 coupled to the power charge chamber 15. The mandrel 24 may be disposed within the axial bore 26 of the second piston 16. It may further have a retainer sub 17 coupled to the second end of the cylindrical body 12. The retainer sub 17 limits the stroke of the second piston 16 with respect to the cylindrical body 12. It may further have a cylindrical sub 13 coupled to the first end of the cylindrical body 12. The cylindrical sub 13 limits the stroke of the second piston 16 with respect to the cylindrical body 12. It may further have a setting sleeve 20 coupled to the second piston 16. It may further have a connector sub 21 coupled to the mandrel 24. It may further have a shear stud 29 coupled to the connector sub 21. It may further have an expandable plug 22 coupled to the shear stud 29. The first piston 11 may stay stationary while the second piston 16 and cylindrical body 12 each move axially away from the first piston 11. The fluid passage 42 may provide fluid communication for a gas between the first end of the first piston 11 and the variable volume pressure chamber 27.

Another example embodiment may include a method for setting a plug 22 in a borehole of activating a firing head 19, starting a gas pressure generating chemical reaction, pressurizing a chamber 27 located within a cylindrical body 12 with the generated gas pressure, moving a piston 16 disposed within the cylinder in a first axial direction with the generated gas, and moving the cylindrical body 12 in the first axial direction with the generated gas.

A variation of the example includes placing a setting tool 10 in a borehole 45 at a predetermined location for installing a plug 22 against casing 46. Moving the piston 11 in the first axial direction acts to evacuate a fluid 30 from the setting tool 10. Moving the cylindrical body 12 in the first axial direction may evacuate a second quantity of oil 31 from the setting tool 10. This will cause seal 47 to radially expand against an inner wall of a borehole casing 46. The action may also shear a shear stud 29 coupled between a setting tool 10 and a setting plug 22. After setting a plug 22 the setting tool 10 is removed from the borehole 45. The radially expanded plug 22 as shown in FIG. 2 may be a bridge plug.

Another example embodiment may include a setting tool 10 having a power charge chamber 15, a cylindrical body 12 having a top end and a bottom end and a longitudinal axis 40 extending through its center from the top end to the bottom end. The setting tool 10 has a top piston 11, with a top end and a bottom end corresponding with the top end and bottom end of the cylindrical body 12. The top piston 11 slidably seals within the cylindrical body 12. A bottom piston 16, having a top end and a bottom end corresponding with the top end and bottom end of the cylindrical body 12, is also located within cylindrical body 12. Bottom piston 16 slidably seals within the cylindrical body 12. A top piston mandrel 48 connects the power charge chamber 15 to the top end of the top piston through the top end of the cylindrical body 12. A gas passage 42 through the top piston mandrel 48 provides fluid communication from the energetic material from the power charge chamber 15 to the pressure chamber 27. A bottom piston mandrel 32 connects the bottom piston 16 to a setting sleeve 20. A setting mandrel 24 extends from the bottom end of the top piston 11 through the bottom piston 16 and bottom piston mandrel 32. The top piston 11, bottom piston 16, and cylindrical body 12 form pressure chamber 27.

A variation of the example may further include a top fluid reservoir 49 formed between the top end of the top piston 11 and the top end of the cylindrical body 12. It may further include a bottom fluid reservoir 50 formed between the bottom end of the bottom piston 16 and the top end of the cylindrical body 12. It may further include a top orifice 43 located proximate to the top end of the cylindrical body 12 and adapted to release fluid 31 from the top fluid reservoir 49 under pressure. It may further include a bottom orifice 44 located proximate to the bottom end of the cylindrical body 12 and adapted to release fluid 30 from the bottom fluid reservoir 50 under pressure. It may further include a bottom sub 17 located proximate to the bottom end of the cylindrical body 12 and adapted to stop the bottom piston 16 from exiting the bottom end of the cylindrical body 12. A top cylindrical sub 13 is located proximate to the top end of the cylindrical body 12 and is adapted to stop the top piston 11 from exiting the top of the cylindrical body 12. The power charge chamber 15, cylindrical body 12, top piston 11, and bottom piston 16 may all be coaxially aligned. The top piston mandrel 48, bottom piston mandrel 32, setting sleeve 20, and setting mandrel 24 may all be coaxially aligned. Energetic charge 23 is disposed within the charge chamber 15. The combustion of the energetic charge 23 creates gas that flows through the gas passage 42 to the pressure chamber 27. The pressure created by the gas moves the bottom piston 16 toward the bottom sub 17 and moves the top end of the cylindrical body 12 down toward the top piston 11. The bottom piston 16 may move toward the bottom sub 17 to pressurize fluid 30 in the bottom fluid reservoir 50, thereby moving it through the bottom orifice 44. The top end of the cylindrical body 12 may move toward the top piston 11 to pressurize fluid 31 in the top fluid reservoir 49, thereby moving it through the top orifice 43.

Although the invention has been described in terms of particular embodiments which are set forth in detail, it should be understood that this is by illustration only and that the invention is not necessarily limited thereto. For example, terms such as upper piston and lower piston can be substituted with top piston and bottom piston, respectfully. Top and bottom could be left and right. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A setting tool apparatus comprising:

a substantially cylindrical body with a center axis;

a first chamber;

a first piston slidably disposed within the first chamber and having a first piston face;

a mandrel extending normal from the first piston face in a first direction;

a second piston slidably disposed in the first chamber and having a second piston face and an axial through bore, wherein the mandrel of the first piston slidably engages through the axial through bore of the second piston, and the first piston face, the second piston face, and the cylindrical body form a pressure chamber.

2. The apparatus, of claim 1 wherein the second piston moves relative to the cylindrical body along the axis in a first direction.

3. The apparatus of claim 2 wherein the cylindrical body moves relative to the first piston along the axis in the first direction.

4. The apparatus of claim 1 further comprising a shear stud coupled to the end of the mandrel, wherein the second piston is located between the first piston and the shear stud along the mandrel.

5. The apparatus of claim 4 further comprising an expandable plug coupled to the shear stud.

6. The apparatus of claim 5 wherein the expandable plug is a bridge plug.

7. The apparatus of claim 1 the first piston further comprising a vent, wherein a fluid can enter the pressure chamber.

8. The apparatus of claim 1 wherein a first fluid reservoir is formed by the first piston and the cylindrical body.

9. The apparatus of claim 1 wherein a second fluid reservoir is formed by the second piston and the cylindrical body.

10. A setting tool apparatus comprising:

a cylindrical body having a center axis, a first end, a second end, at inner surface, and an outer surface;

a first piston located within the cylindrical body and axially aligned with the cylindrical body, having a first end and a second end, and a fluid passage connecting the first end to the second end;

a cylindrical mandrel extending from the second end of the first piston and being axially aligned with the cylindrical body;

a second piston located within the cylindrical body and axially aligned with the cylindrical body;

an axial bore throughout the length of the second piston, with a first end and a second end;

wherein the first end of the second piston, the second end of the first piston, and the cylindrical body form a variable volume pressure chamber.

11. The apparatus of claim 10 further comprising a sub connected to the first end of the cylindrical body having at least one orifice placing a first portion of the inside of the cylindrical body in fluid communication with the outside of the cylindrical body.

12. The apparatus of claim 10 further comprising a sub connected to the second end of the cylindrical body having at least one orifice placing a second portion of the inside of the cylindrical body in fluid communication with the outside of the cylindrical body.

13. The apparatus of claim 10 further comprising a power charge located proximate to the cylindrical body, wherein gases generated by the power charge can enter the fluid passage of the first piston at the first end and exit at the end of the fluid passage at the second end and enter the variable volume pressure chamber.

14. The apparatus of claim 13 further comprising a firing head coupled to the power charge.

15. The apparatus of claim 10 wherein the mandrel is disposed within the axial bore of the second piston.

16. The apparatus of claim 10 further comprising cylindrical sub coupled to the second end of the cylindrical body, wherein the cylindrical sub limits the stroke of the second piston with respect to the cylindrical body.

17. The apparatus of claim 10 further comprising cylindrical sub coupled to the first end of the cylinder body, wherein the cylindrical sub limits the stroke of the second piston with respect to the cylindrical body.

18. The apparatus of claim 10 further comprising a setting sleeve coupled to the second piston.

19. The apparatus of claim 10 further comprising a connector sub coupled to the mandrel.

20. The apparatus of claim 19 further comprising a shear stud coupled to the connector sub.

21. The apparatus of claim 20 further comprising an expandable plug coupled to the shear stud.

22. The apparatus of claim 10 wherein the first piston stays stationary while the second piston and cylindrical body each move axially away from the first piston.

23. The apparatus of claim 10 wherein the fluid passage provide fluid communication for a gas between the first end of the first piston and the variable volume pressure chamber.

24. A method for setting a plug in a borehole comprising:

activating a firing head;

starting a gas pressure generating chemical reaction;

pressurizing a chamber located with a cylinder with the generated gas pressure;

moving a piston disposed within the cylinder in a first axial direction with the generated gas;

moving the cylinder in the first axial direction with the generated gas.

25. A method as in claim 24 further comprising placing a setting tool in a borehole at a predetermined location for installing a bridge plug.

26. A method as in claim 24 further comprising evacuating a first quantity of oil from the setting tool by moving the piston in the first axial direction.

27. A method as in claim 24 further comprising evacuating a second quantity of oil from the setting tool by moving the cylinder in the first axial direction.

28. A method as in claim 24 further comprising expanding a seal radially against an inner wall of a borehole casing.

29. The method as in claim 28 wherein the radially expanded seal is a bridge plug.

30. A method as in claim 24 further comprising shearing a shear stud coupled between a setting tool and a setting plug.

31. A method as in claim 24 further comprising removing the setting tool from the borehole after setting a bridge plug.

* * * * *